United States Patent [19]

Eriksson

[11] 4,452,321

[45] Jun. 5, 1984

[54] DEVICE IN CORE BARRELS

[75] Inventor: Sune W. Eriksson, Spånga, Sweden

[73] Assignee: Craelius AB, Bromma, Sweden

[21] Appl. No.: 308,527

[22] Filed: Oct. 5, 1981

[30] Foreign Application Priority Data

Oct. 10, 1980 [SE] Sweden ..... 8007130

[51] Int. Cl.[3] ..... E21B 25/00

[52] U.S. Cl. ..... 175/46; 175/236; 175/247; 175/243

[58] Field of Search ..... 175/46, 245, 246, 247, 175/248, 232, 234, 236, 239, 243, 317

[56] References Cited

U.S. PATENT DOCUMENTS

| | | | |
|---|---|---|---|
| 2,857,138 | 10/1958 | Svendsen et al. | 175/317 |
| 3,225,845 | 12/1965 | Koontz et al. | 175/246 |
| 3,305,033 | 2/1967 | Pickard et al. | 175/246 |
| 3,346,059 | 10/1967 | Svendsen . | |
| 3,777,826 | 12/1973 | Wolda | 175/46 |

FOREIGN PATENT DOCUMENTS

| | | | |
|---|---|---|---|
| 1014944 | 8/1977 | Canada . | |
| 829317 | 9/1978 | U.S.S.R. | 175/247 |

*Primary Examiner*—Stephen J. Novosad
*Assistant Examiner*—William P. Neuder
*Attorney, Agent, or Firm*—Barnes & Thornburg

[57] ABSTRACT

A device in core drilling for indicating when a core barrel placed in a rotatable hollow drill rod is no longer capable of receiving a further quantity of reamed-out core material includes a valve which at said condition of the barrel constricts the passage for flushing medium flowing between the core barrel and the bore of the drill rod so that a readable flushing medium pressure increase occurs. The valve closes off said passage incompletely to allow a minor quantity of flushing medium to be taken to the drill bit mounted at the bottom of the drill rod, thereby to prevent said drill bit from being burnt out.

6 Claims, 2 Drawing Figures

DEVICE IN CORE BARRELS

DESCRIPTION

1. Technical Field

The present invention relates to a device in core drilling for indicating when a core barrel in a rotatable outer hollow drill rod is no longer capable of accommodating any more drilled core material.

2. Background Art

It is already known to indicate to a core drill operator when a core barrel has been filled with core, or when a so-called core blockage occurs. When the operator in question receives this indication, drilling must be broken off and the core barrel taken up out of the drill rod.

A known device for accomplishing said indication includes an annular elastic valve, mounted between two parts in the core barrel which are axially displaceable in relation to each other, of which the one, i.e. the portion accommodating the core is displaced towards the other portion axially fixed in the hollow drill rod when the core barrel is full or when a core blockage has occurred. At this displacement, the valve is compressed and thereby expands radially so that its annular cylindrical surface presses sealingly against an annular inner surface of the drill rod. This seal results in that flushing medium, which is forced down the drill rod string and which is used, inter alia, for cooling and flushing the bit attched to the bottom of the drill rod, cannot pass the space between the rod bore and the core barrel, whereby the pressure of the flushing medium above the seal increases. This pressure increase can be read on a gauge mounted on the drill rig and constitutes said indication.

The known device described above has been found to function satisfactorily if complete control can be maintained over the flushing medium pressure and core blockages, but is unsuitable to use if drilling is done without this control, since the bit is rapidly burnt out in such cases when the supply of flushing slurry to it ceases, and the rig operator does not immediately notice that the gauge pressure has increased. Another drawback with the known device is that its valve can be subjected to such a large compressive force that it is destroyed and must be exchanged, which is both time-consuming and expensive.

DISCLOSURE OF INVENTION

The object of the present invention is to provide a device of the kind described in the introduction, by means of which the drawbacks of previously known devices are circumvented.

This object is achieved by the apparatus in accordance with the invention being given the characterizing features disclosed in the claims.

The primary advantage with the inventive device is that a sufficiently large amount of flushing medium is supplied to the drill bit for preventing its being burnt out, even after the core barrel is filled or a core blockage has occurred and drilling continues, in spite of the gauge indication that the flushing medium pressure has increased to an unacceptable level. Another advantage is that the valve included in the device can never be loaded (compressed together) so that it is permanently deformed or otherwise destroyed. A still further advantage is that the pressure to which the valve can at most be subjected is settable. This setting facility signifies that the radial distance between the valve and the drill rod bore can be varied, and even reduced so that the flushing passage is completely closed, which can be desirable in some applications.

PREFERRED EMBODIMENT

Figure 1:
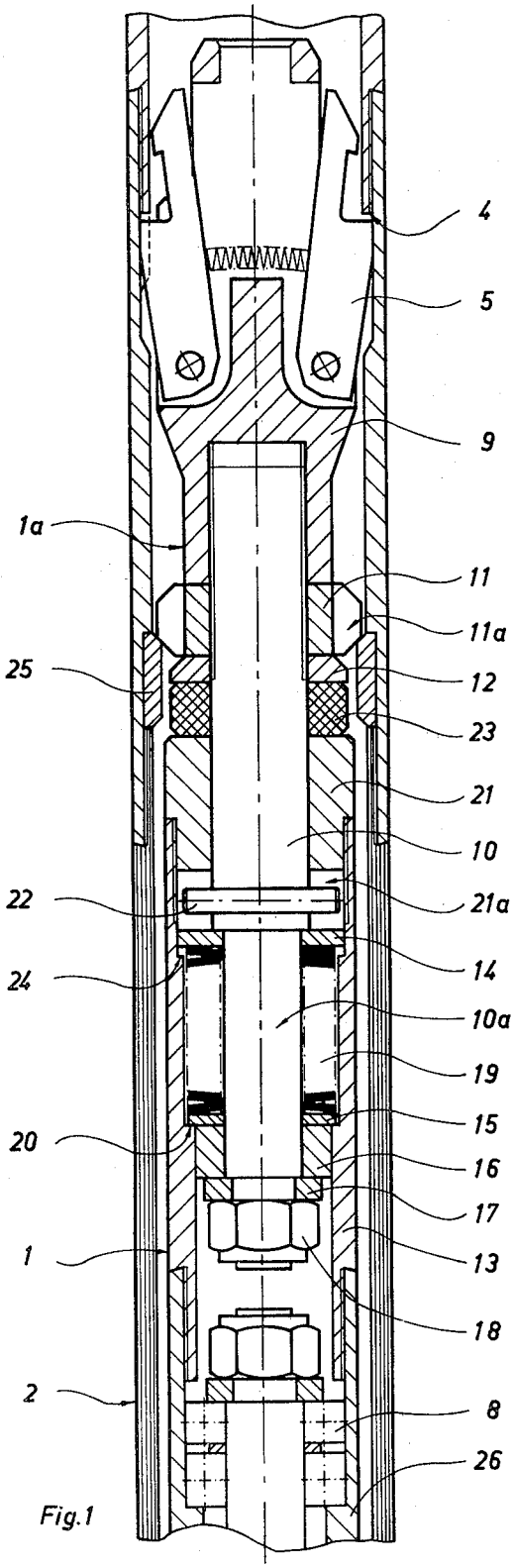
FIG. 1 is a sectional side view of the upper part of a core barrel including the inventive device, and assuming a working position in a drill rod string.
Figure 2:
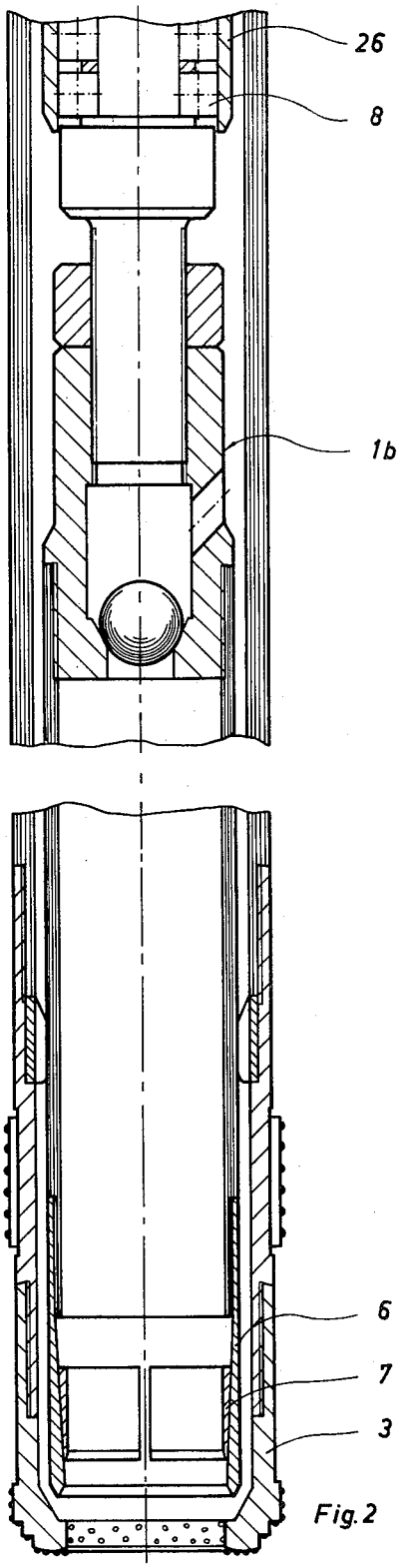
FIG. 2 is a sectional side view of the lower portion of the core barrel and the bottom of the drill rod string in FIG. 1.

The core barrel illustrated in FIGS. 1 and 2 and generally denoted by the numeral 1 comprises an upper portion 1*a*, which is rotatable together with the drill rod 2, and a lower part 1*b* which does not rotate relative the drill rod and which is intended to accommodate a drilled core. The rod 2 forms the bottom section of a rotating drill rod string usually comprising several rods, which are connected to a drill rig of a conventional kind. The rod 2 is also of conventional embodiment, inter alia with a bit 3 and a recess which, via gripping jaws 5 rotatably mounted in the upper part 1*a* of the core barrel, prevent the latter from being displaced upwards inside the rod 2 from the working position illustrated in the figures. The bottom portion of the core barrel 1 is also of conventional implementation with a core collecting sleeve 6 and a core catching sleeve 7.

The bottom portion 1*b* of the barrel 1 is conventionally rotatably connected to the upper part 1*a* by means of a ball bearing arrangement 8. The upper part 1*a* includes a body 9 carrying the gripping jaws 5, a shaft 10 in threaded connection with the body 9, a lock nut 11 provided with flushing medium ducts 11*a*, said nut locking the shaft 10 to the body 9 and also limiting the depth to which the barrel can be sunk in the drill rod, and a washer 12 displaceably mounted on the shaft 10 and engaging against the nut 11. The part 1*a* also includes a sleeve 26 coating with the ball bearing arrangement 8 and connected to a sleeve 13 surrounding a portion of the shaft 10 and an extension 10*a* thereof. A pack 19 of Bellville washers is inserted between a washer 14 and a washer 15, glidably mounted on the extension and engaging against a sleeve 16, which in turn engages against a washer 17 retained on the extension by a nut 18. The spring pack urges with a predetermined force, which can be varied by inserting different numbers of Bellville washers between the washers 14 and 15, the bottom part 1*b* of the core barrel 1 downwards in FIG. 2 via the washer 15, which is urged against a shoulder 20 on the sleeve 13, the latter being axially rigidly connected, via the sleeve 26, to the portion of the bottom part 1*b* shown in FIG. 2.

At its upper end illustrated in FIG. 1, the sleeve 13 is threaded onto a sleeve 21 partially surrounding a shaft 10, the lower end of said sleeve being provided with recesses 21*a* and engaging against the washer 14, while being non-rotatably fixed to the shaft by means of a locking pin 22 attached to the shaft 10 and projecting into the recesses 21*a*. Between the sleeve 21 and washer 12 there is inserted an elastic ring 23, forming a valve, the function of which will now be described in conjunction with the description of the function of the device in accordance with the invention.

Flushing medium is forced down into the drill rod string during drilling and passes between the bore of the rod 2 and the core barrel 1 before it reaches the bit 3. When the bottom part 1*b* of the barrel has taken up a maximum length of core material, or when a core blockage occurs, the part 1*b* is pressed upwards relative the upper part 1*a*, which cannot be displaced upwards in the rod 2 due to the gripping jaws 5 and shoulder 4. This upward pressure takes place against the action of the force in the spring pack 19, which is thus compressed, and against the action of the force in the ring 23 which is also compressed. The compression of the spring pack 19 and ring 23 is however limited by an annular recess 24 on the sleeve 13, being brought into engagement against the washer 14, after about 4 millimeters' compression of the spring pack, and therefore also after about 4 millimeters' compression of the ring 23.

When the ring 23 is compressed, its outer diameter is expanded so that it will be about 1 millimeter less than the inner diameter of an abutment ring 25 attached to the inside of the drill rod 2, and coacting with the nut 11, whereby an annular flushing gap with a width of about 0,5 mm is formed between the rings 23 and 25. This flushing gap was about 2,6 mm wide before the ring 23 was compressed.

The reduction of said flushing gap results in an increased water pressure inside the drill rod 2 above the rings 23 and 25, which the drill rig operator reads off on a gauge mounted on the rig. An indication is thus obtained that the core barrel is no longer capable of accommodating further core material, and drilling must be broken off for the barrel to be pulled up out of the drill rod string with the aid of a grappling means known per se and not illustrated. Should the operator not immediately notice that the water pressure increases and drilling is therefore allowed to continue, there is no risk even so that the drill bit 3 will be spoiled or damaged due to flushing medium supply being cut off, since the flushing gap between the rings 23 and 25 lets through a certain amount of flushing medium to the drill bit.

Depending on the limited movement between the washer 12 and sleeve 21, the ring 23 can never be compressed so that it is permanently deformed or otherwise destroyed. In certain applications, if it is desired to obtain a less or greater compression of the ring 23 than the one described above, or if there is a desire of compressing the ring so much that it sealingly engages against the abutment ring 25, the distance between the washer 12 and the sleeve 21 can be varied, which is done by screwing the locking nut 11 a short distance away from the body 9 when the core barrel has been taken up from the string, after which the body is turned relative the shaft 10 until the body assumes a position relative the shaft corresponding to the desired distance. The lock nut 11 can subsequently be tightened once again. After having loosened the lock nut 11, the body 9 can be screwed off the shaft 10, if so desired, and be removed from the shaft together with the lock nut and washer 12, after which the ring 23 can be removed and exchanged for another ring.

Even if only one embodiment of the invention has been described and illustrated on the drawing, it should be understood that the invention is not limited to this embodiment but only by the disclosures in the claims.

I claim:

1. A device in core drilling for indicating when a core barrel located in a hollow drill rod is no longer capable of accommodating a further quantity of core material, comprising a valve member, the core barrel including a part movable axially of the drill rod, means for mounting the valve member for operation by movement of the core barrel movable part axially of the drill rod, means on the drill rod for cooperating with the valve member to define a drilling fluid flow passageway therebetween, movement of the core barrel movable part varying the fluid flow passageway, means separate from the valve member for stopping the axial movement of the core barrel movable part, and means for permitting adjustment of the position of the stop means to permit a preselected desired amount of drilling fluid to flow through the passageway between the valve member and the means on the drill rod for cooperating with the valve member when the core barrel movable part and valve member are stopped.

2. A device in core drilling for indicating when a core barrel located in a hollow drill rod is no longer capable of accommodating a further quantity of core material, comprising a valve member, the core barrel comprising an upper core barrel part and a separate lower core barrel part movable axially of the drill rod, means for coupling the upper and lower core barrel parts for axial movement relative to each other, means for mounting the valve member for operation by movement of the core barrel movable part axially of the drill rod, means on the drill rod for cooperating with the valve member to define a drilling fluid flow passageway therebetween, movement of the core barrel movable part varying the fluid flow passageway, and means for stopping the axial movement of the core barrel movable part, the means for stopping the axial movement of the core barrel movable part including complementary shoulders provided on the upper and lower core barrel parts for movement into engagement to stop their relative axial movement, and means for permitting adjustment of the relative positions of the complementary shoulders to permit a preselected desired amount of drilling fluid to flow through the passageway when the lower core barrel part and valve member are stopped.

3. The invention of claim 2 wherein the upper core barrel part is fixed for movement axially downward with the drill rod.

4. The invention of claim 3 and further comprising means for yieldably urging the upper and lower core barrel parts axially away from each other.

5. The invention of claim 4 wherein the means for yieldably urging the upper and lower core barrel parts axially away from each other comprises a Bellville washer stack.

6. The invention of claim 4 wherein the valve member comprises an elastomeric ring and the means for coupling the upper and lower core barrel parts for axial movement relative to each other comprises means for mounting the elastomeric ring between the upper and lower core barrel parts such that relative axial movement of the upper and lower core barrel parts toward each other compresses the ring axially and permits it to expand radially toward the means on the drill rod cooperating with the valve member.

* * * * *